US010100420B2

(12) United States Patent
Sun et al.

(10) Patent No.: US 10,100,420 B2
(45) Date of Patent: Oct. 16, 2018

(54) PLATING LEVELER FOR ELECTRODEPOSITION OF COPPER PILLAR

(71) Applicant: Hong Kong Applied Science and Technology Research Institute Company Limited, Hong Kong (HK)

(72) Inventors: Yaofeng Sun, Hong Kong (HK); Minjie Xu, Hong Kong (HK); Shun Yee Lao, Honk Kong (HK); Shu Kin Yau, Hong Kong (HK)

(73) Assignee: Hong Kong Applied Science and Technology Research Institute Company Limtied, Hong Kong (HK)

( * ) Notice: Subject to any disclaimer, the term of this patent is extended or adjusted under 35 U.S.C. 154(b) by 250 days.

(21) Appl. No.: 14/983,508

(22) Filed: Dec. 29, 2015

(65) Prior Publication Data

US 2017/0183791 A1 Jun. 29, 2017

(51) Int. Cl.
*C25D 3/38* (2006.01)

(52) U.S. Cl.
CPC ..... *C25D 3/38* (2013.01)

(58) Field of Classification Search
CPC ..... C25D 3/38
USPC ..... 205/296, 297, 298
See application file for complete search history.

(56) References Cited

U.S. PATENT DOCUMENTS 3,885,913 A * 5/1975 Redmore ..... C08G 65/33303 252/390
4,212,764 A * 7/1980 Quinlan ..... C23F 11/10 106/14.13
4,404,377 A * 9/1983 Seale ..... B01F 17/0042 544/177
4,555,315 A 11/1985 Barbieri et al.
4,908,242 A * 3/1990 Hughes ..... C23C 18/1617 106/1.23
6,610,192 B1 8/2003 Step et al.
7,662,981 B2 2/2010 Wang et al.
8,114,263 B2 2/2012 Dahms et al.
8,679,317 B2 3/2014 Isono et al.
2006/0016693 A1 1/2006 Wang et al.
2006/0062753 A1* 3/2006 Naraghi ..... A01N 33/12 424/78.27

(Continued)

FOREIGN PATENT DOCUMENTS

CA 1108087 A 9/1981
CN 103060860 A 4/2013

(Continued)

OTHER PUBLICATIONS

Williams et al., "Effect of Copper Content of Carbon Steel on Corrosion in Sulfuric Acid," Corrosion (Jan. 1965), vol. 21, No. 1, pp. 9-14. (Year: 1965).*

(Continued)

*Primary Examiner* — Edna Wong

(74) *Attorney, Agent, or Firm* — Spruson & Ferguson (Hong Kong) Limited

(57) ABSTRACT

The presently claimed invention provides a plating additive for electrodeposition, and the corresponding fabrication method thereof. The plating additive of the present invention enables to electroplate holes on a substrate with good height uniformity within a feature and among features at different diameters.

14 Claims, 6 Drawing Sheets

Formula (I)

(56) References Cited

U.S. PATENT DOCUMENTS

| | | | | |
|---|---|---|---|---|
| 2010/0126872 | A1 | 5/2010 | Paneccasio, Jr. et al. | |
| 2011/0315604 | A1* | 12/2011 | Nguyen | B01D 17/047 208/188 |
| 2012/0318676 | A1 | 12/2012 | Najjar et al. | |
| 2013/0068626 | A1 | 3/2013 | Siemer et al. | |

FOREIGN PATENT DOCUMENTS

| | | | | |
|---|---|---|---|---|
| CN | 103289670 | A * | 9/2013 | C08G 65/28 |
| WO | 2006094755 | A1 | 9/2006 | |

OTHER PUBLICATIONS

International Search Report and Written Opinion issued for PCT Application No. PCT/CN2016/070766 dated Sep. 20, 2016.

Libor Matejka et al. "Model reactions of amine curing of glycidylamine epoxy resins Homopolymerization of N-methylglcidylaniline", Jornal of Polymer Science Part A-Polymer Chemistry, Sep. 30, 1992, vol. 30 Issue 10, pp. 2109-2120.

Office Action of CN 201680000067.2 issued from the State Intellectual Property Office of the People's Republic of China dated Aug. 27, 2018.

* cited by examiner

Formula (I)

Formula (II)

Formula (III)

Formula (IV)

Formula (V)

(A)

(B)

(C)

(D)

| Dia. (um) | OM Top View | Typical Contour | Height Diff. (um) | Within-feature Uniformity | Among-feature Uniformity |
|---|---|---|---|---|---|
| 28 |  |  | 0.30 | 0.42% | 3.9% |
| 43 |  |  | 0.97 | 1.36% | |
| 58 |  |  | 1.65 | 2.29% | |
| 88 |  |  | 1.34 | 1.74% | |

(E)

PLATING LEVELER FOR ELECTRODEPOSITION OF COPPER PILLAR

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to a plating additive for electrodeposition, more particularly, the present invention relates to a plating leveler for electrodeposition, and the corresponding fabrication methods thereof.

BACKGROUND

Traditionally, solder bump was used on the lead pad of IC chip on wafers for flip chip assembly. However, copper (Cu) pillar bump gradually takes the place of the solder bump as a next generation flip chip interconnect which offers advantages in many designs while meeting current and future ROHS requirements. During electroplating of Cu pillar, a voltage drop variation typically exists along an irregular surface of a substrate which can result in an uneven metal deposit on the substrate. Some parts of the substrate would have been overplated while other parts would have been underplated.

In order to solve the problems, plating levelers could be added into the electroplating bath in order to achieve a uniform metal deposit on a substrate surface.

CA1108087 discloses a method and bath for the electrodeposition of bright to semi-bright zinc plate, wherein there is incorporated into the bath a water soluble additive which is a polymer derived from polyepichlorohydrin or polyepibromohydrin and a tertiary amine and wherein a quaternary group +NR3—replaces at least 25 percent of the halide groups of the polyhalohydrin. In the quaternary ammonium group, X is a chloride or bromide group and R is an alkyl, alkenyl, alkynyl or alkanol radical or mixtures thereof, each radical containing from 1 to 4 carbon atoms.

U.S. Pat. No. 4,555,315 discloses an improved electrolyte composition and process for electrodepositing bright, level and ductile copper deposits on a substrate. A constituent of the additive system comprises a bath soluble adduct of a tertiary alkyl amine with polyepichlorohydrin bath soluble adduct of a tertiary alkyl amine with polyepichlorohydrin.

U.S. Pat. No. 6,610,192 discloses a method of electroplating copper on an integrated circuit substrate having ≤2 μm apertures comprising the steps of contacting the substrate to be plated with a copper electroplating bath comprising one or more leveling agents. The leveling agent is a reaction product of a heterocyclic amine with an epihalohydrin.

U.S. Pat. No. 7,662,981 discloses a leveler compound for depositing metal layers using plating baths. The leveler is a reaction product of an amine with a polyepoxide. U.S. Pat. No. 8,114,263 discloses a polyvinylammonium compound for electrolytically depositing a copper deposit. US2010/0126872 discloses a leveler compound being a reaction product of a dipyridyl compound and an alkylating agent.

US2013/0068626 discloses a leveling agent comprising a linear or branched, polymeric imidazolium compound.

Although the conventional levelers may improve the quality of metal deposit done by electroplating on the substrate surface, they are still not able to meet the tight requirements of height uniformity for electroplating of copper pillars with different diameters in the recent IC technology. Poor height uniformity of copper pillar can significantly affect the electric conductivity and stability of the wafer assembly since connection bonding between the two copper bumps of two wafers may not be fully connected and copper pillar pairs with lower height may not be well contacted.

There is a need in the art to have a plating additive for electroplating of copper pillars with different diameters, which provides good surface flatness and height uniformity.

SUMMARY OF THE INVENTION

Accordingly, a first aspect of the present invention is to provide a plating additive for a copper electroplating bath.

In accordance to an embodiment of the presently claimed invention, a plating additive for a copper electroplating bath, has a general chemical formula (I) as shown in FIG. 1A; wherein X comprises at least one of: a hydrogen, an alkyl group, a mono-alcohol, a di-alcohol, a tri-alcohol, or a poly-alcohol; wherein Y comprises at least one of: a hydrogen, a mono-alcohol, a di-alcohol, a tri-alcohol, or a poly-alcohol; wherein R is a nitrogen atom containing group; and wherein n is a number from 2 to 250.

Preferably, the nitrogen atom containing group is a secondary ammonium group comprising a branched or unbranched, saturated or unsaturated linear secondary ammonium.

Preferably, the nitrogen atom containing group is a cyclic ammonium group comprising a substituted or unsubstituted, saturated or unsaturated cyclic secondary ammonium.

Preferably, the nitrogen atom containing group is a cyclic ammonium group comprising a saturated or unsaturated, N-substituted cyclic tertiary ammonium.

Preferably, the nitrogen atom containing group is a cyclic ammonium group comprising a substituted or unsubstituted aromatic ammonium.

A second aspect of the present invention is to provide a process for preparing the plating additive of the present invention for use in electroplating.

In accordance to an embodiment of the presently claimed invention, a process for preparing a plating additive for use in electroplating comprises: mixing an alcohol with a catalyst together for a first reaction under a first condition to form a first intermediate; reacting the first intermediate with Epihalohydrin for a second reaction under a second condition to form a second intermediate; and reacting the second intermediate with an ammonium containing solution for a third reaction under a third condition with reflux.

A third aspect of the present invention is to provide a copper electroplating bath for use in electroplating.

In accordance to an embodiment of the presently claimed invention, a copper electroplating bath comprises: a solution containing plating material, and the plating additive of the present invention, wherein the plating additive comprises a concentration of 1 to 200 mg/L.

A fourth aspect of the present invention is to provide a method for electroplating copper on one or more holes on a substrate.

In accordance to an embodiment of the presently claimed invention, a method for electroplating copper on one or more holes on a substrate comprises: bringing the substrate and an anode into contact with a copper electroplating bath; and generating an electric current flow between the substrate and the anode; wherein the copper electroplating bath comprises copper ions and the plating additive of the present invention.

The plating additive of the present invention is able to provide outstanding height uniformity within pillar and among pillars at different via diameters.

BRIEF DESCRIPTION OF THE DRAWINGS

Embodiments of the present invention are described in more detail hereinafter with reference to the drawings, in which.

DETAILED DESCRIPTION

In the following description, plating levelers, and the corresponding fabrication methods and application thereof are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1A:
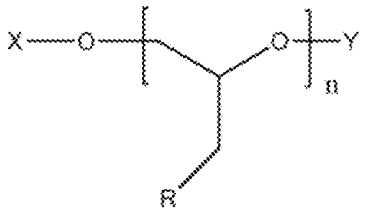
FIG. 1A shows a leveler compound with general chemical formula (I) according to an embodiment of the present invention.

Accordingly, the present invention, in one aspect, provides a compound represented by general chemical formula (I) as shown in FIG. 1A, wherein X and Y are with the same or different structure, representing hydrogen, alkyl group, mono-, di-, tri- or poly-alcohol; R is a nitrogen atom containing group, and n is an integer from 2 to about 250.

R can be a secondary ammonium group or a cyclic ammonium group. R can be one of the functional groups A, B, C, and D. The functional group A is saturated or unsaturated linear secondary ammonium; the functional group B is substituted or unsubstituted, saturated or unsaturated cyclic secondary ammonium; the functional group C is saturated or unsaturated, N-substituted cyclic tertiary ammonium; and the functional group D is substituted or unsubstituted aromatic ammonium.

Figure 1B:
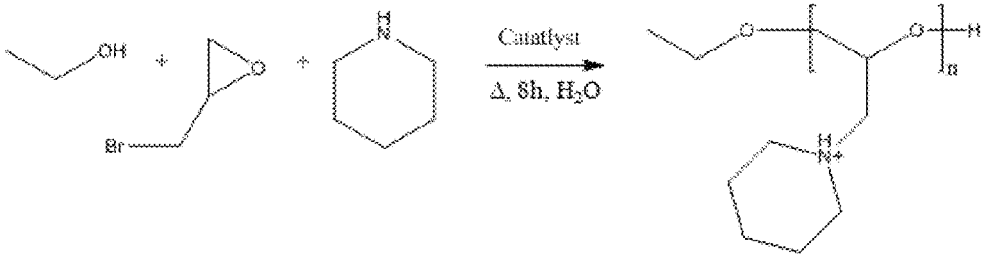
FIG. 1B shows the structures of functional groups A, B, C and D according to an embodiment of the present invention.

In one embodiment of the present invention, the functional groups A, B, C, and D comprise the structures as shown in FIG. 1B. $R_1$-$R_5$ represents methyl, ethyl or other linear or branched aliphatic chain. $R_6$ represents aliphatic chain with conjugated double bonds. $R_1$-$R_5$ can have heteroatoms included.

Figure 1C:
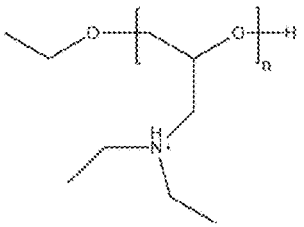
FIG. 1C shows a leveler compound with formula (II) according to an embodiment of the present invention.

In one exemplary embodiment of the present invention, R is represented by the functional group A, a compound has formula (II) as shown in FIG. 1C.

Figure 1D:
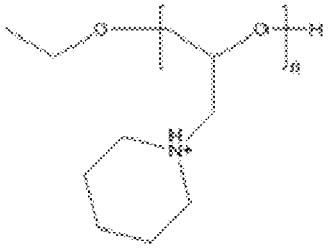
FIG. 1D shows a leveler compound with formula (III) according to an embodiment of the present invention.

In another exemplary embodiment of the present invention, R is represented by the functional group B, a compound has formula (III) as shown in FIG. 1D.

Figure 1E:
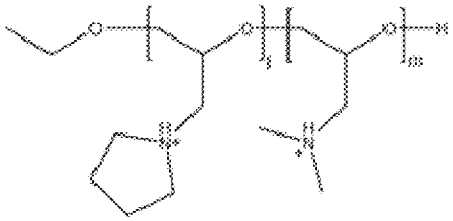
FIG. 1E shows a leveler compound with formula (VI) according to an embodiment of the present invention.

In still another exemplary embodiment, R is a combination of the functional group A and B, a compound has formula (IV) as shown in FIG. 1E. l+m is equal to n. l can be a number from 1 to 249; and m can be a number from 1 to 249.

Figure 1F:
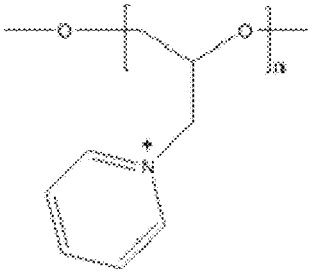
FIG. 1F shows a leveler compound with formula (V) according to an embodiment of the present invention.

In still another exemplary embodiment of the present invention, R is represented by the functional group D, a compound has formula (V) as shown in FIG. 1F.

According to another aspect of the present invention, the process for preparing an electroplating leveler is illustrated as follows. A proposed alcohol and a catalyst are mixed together for a first reaction under a first condition to form a first intermediate. In one embodiment, the first reaction is conducted for 0.5-10 h under the room temperature. After the first reaction, the first intermediate is further brought into contact with Epihalohydrin for a second reaction under a second condition to form a second intermediate. In one embodiment, the second reaction is conducted for 0.5-10 h under the room temperature. In still one embodiment, the Epihalohydrin could be Epibromohydrin. Finally, the reagent formed from the second reaction is brought into contact with a proposed ammonium for a third reaction under a third condition with reflux to form the additive compound/molecule according to one specific embodiment of the present invention. In one embodiment, the third reaction is conducted for 8-24 h under the temperature of 80-120° C. In still one embodiment, the proposed ammonium could be piperidine.

Figure 2A:
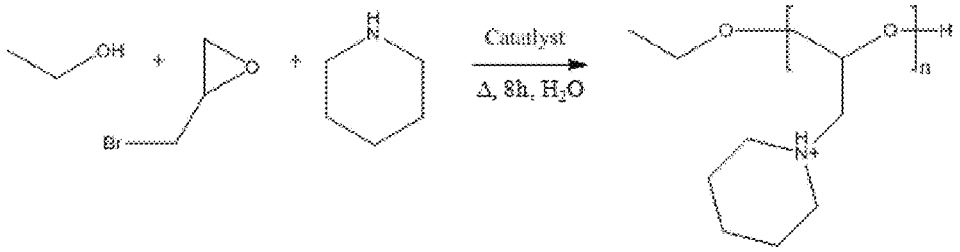
FIG. 2A illustrates a method of producing the electroplating leveler according to one specific embodiment of the present invention.

FIG. 2A shows a method of producing an electroplating leveler according to one embodiment of the present invention. Ethanol is mixed with a catalyst to form a mixture. Then, the mixture is further mixed and reacted with Epibromohydrin to form an intermediate. Then, the intermediate is further mixed and reacted with piperidine to from an additive compound represented by formula (III).

Figure 2B:
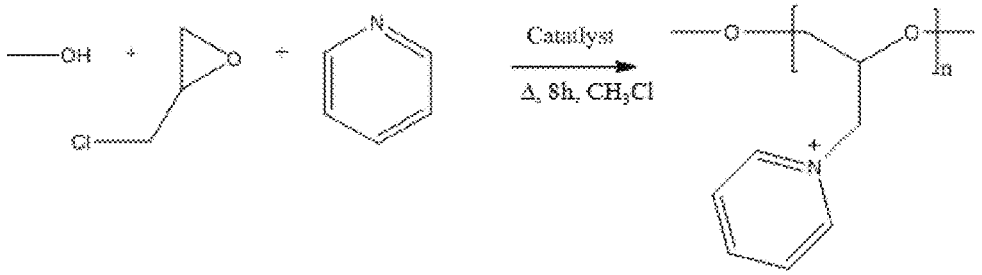
FIG. 2B illustrates a method of producing the electroplating leveler according to another specific embodiment of the present invention.

FIG. 2B shows a method of producing the electroplating leveler according to another specific embodiment of the present invention. The producing process of FIG. 2B is similar to FIG. 2A. The only difference is that Epibromohydrin is replaced by Epichlorohydrin as the Epihalohydrin and piperidine is replaced by pyridine as the proposed ammonium, so as to form the additive compound/molecule according to another specific embodiment of the present invention, i.e., the compound represented by formula (V).

Manufacturing Embodiment 1

1 g of Ethanol and 0.5 g of boron trifluoride $BF_3$ being a catalyst dissolved in Ethyl Acetate were mixed, and stirred for 0.5-10 hr under the room temperature to form an intermediate. Epichlorohydrin (10-1000 g) was added into the intermediate with stirring for 0.5-10 hr. The reaction was quenched by adding in 100 ml $H_2O$. The unreacted Epichlorohydrin was removed by Speedvac (vacuum concentrator).

The left intermediate was mixed with Diethylamine (10-1000 g) and stirred for 8-24 hr under 80-120° C. with reflux.

Manufacturing Embodiment 2

1 g of Ethanol and 0.5 g of $BF_3$ dissolved in Ethyl Acetate were mixed, and stirred for 0.5-10 hr under the room temperature to form an intermediate. Epibromohydrin (10-1000 g) was added into the intermediate with stirring for 0.5-10 hr. The reaction was quenched by adding in 100 ml $H_2O$. The unreacted Epibomohydrin was removed by Speedvac. The left intermediate is mixed with Piperidine (10-1000 g) and stirred for 8-24 hr under 80-120° C. with reflux.

Manufacturing Embodiment 3

1 g of Ethanol and 0.5 g of $BF_3$ dissolved in Ethyl Acetate were mixed, stirred for 0.5-10 hr under the room temperature to form an intermediate. Epibromohydrin (10-1000 g) was added into the intermediate with stirring for 0.5-10 hr. The reaction was quenched by adding in 100 ml $H_2O$. The unreacted Epibromohydrin was removed by Speedvac. The left intermediate is added with Piperidine and Diethylamine simultaneously (10-1000 g in all), and then stirred for 8-24 hr under 80-120° C. with reflux.

Manufacturing Embodiment 4

1 g of Methanol and 0.5 g of $BF_3$ dissolved in Ethyl Acetate were mixed, stirred for 0.5-10 hr under the room temperature with stirring for 0.5-10 hr to form an intermediate. Epichlorohydrin (10-1000 g) was added into the intermediate with stirring for 0.5-10 hr. The reaction was quenched by adding in 100 ml $H_2O$. The unreacted Epichlorohydrin was removed by Speedvac. The left intermediate is mixed with Pyridine (10-1000 g) and stirred for 8-24 h under 80-120° C. with reflux.

Now turning to a method of electro-deposition for plating metal onto a substrate with the electroplaing leveler of the present invention. In one embodiment of the present invention, the substrate comprises at least one recess, hole or dimple. In another embodiment of the present invention, the electro-deposition is an electroplating of copper onto a substrate.

The method of electroplating a substrate with a plating material comprises the steps of firstly preparing an electroplating bath comprising the electroplating leveler of the present invention as described above and a solution that contains the plating material. In one embodiment of the present invention, the electroplating bath further comprises a suppressor and an accelerator. The non-ionic high molecular polymer is mainly used as suppressor ingredient and the accelerator is a typically low molecular weight sulfurcontaining compound, such as bis(sodiumsulfopropyl)disulfide (SPS). In one specific embodiment of the present invention, the suppressor is selected from the group consisting of polyethylene glycol PEG, polypropylene glycol PPG or copolymers thereof. The concentration of the suppressor is between 10 to 2000 mg/L. In another embodiment of the present invention, the solution that contains the plating material is an acidic copper (II) sulfate (i.e. $CuSO_4$) solution. In one specific embodiment of the present invention, the concentration of the additive compound/molecule and copper ion in the electroplating bath is between 1 to 200 mg/L and 10 to 80 g/L respectively. In another specific embodiment of the present invention, the electroplating bath further comprises an organic acid or an inorganic acid at the concentration of 5 to 200 g/L. In yet another embodiment, the electroplating bath further comprises halogen ions and one or more components selected from the group consisting of sulfoalkyl sulfonic acids or salts thereof, bissulfo-organic compounds and dithiocarbamic acid derivatives. The concentration of the halogen ions and the components are 10 to 100 mg/L and 0.1 to 200 mg/L respectively.

After the electroplating bath has been prepared, the substrate is submerged into the electroplating bath. An electric current is then applied to the substrate for a predetermined period of time, for example 60 minutes, such that the plating material is attached onto the surface of the substrate thereby forming a plating on the substrate.

A performance test for the leveler of the present invention was conducted. Copper ion at 10-80 g/L, an organic acid or an inorganic acid, preferably sulfuric acid, at 5-200 g/L, a kind of halogen ion, Cl—, at 10-100 mg/L, an accelerator such as sulfoalkyl sulfonic acids or salts, bissulfo-organic compounds and dithiocarbamic acid derivatives at 0.1-200 mg/L, a suppressor such as Poly Ethylene Glycol at 10-2000 mg/L were used. The plating additive, manufactured by the Manufacturing Embodiment 1 and having the chemical formula (II), at 0.1-1000 mg/L was used for testing.

Figure 3:
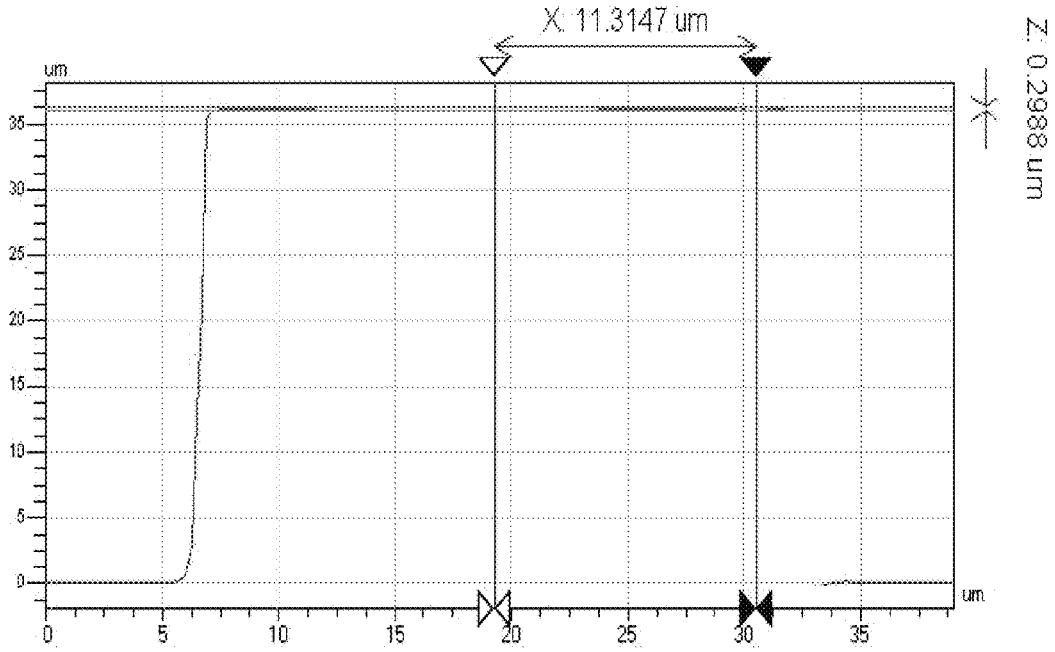
FIG. 3 shows the results of a study of the effect of levelers on electroplating multiple copper pillars including a) surface profile at 28 μm, b) surface profile at 43 μm, c) surface profile at 58 μm, d) surface profile at 88 μm, and e) result summary table according to one embodiment of the present invention.
Figure 3:
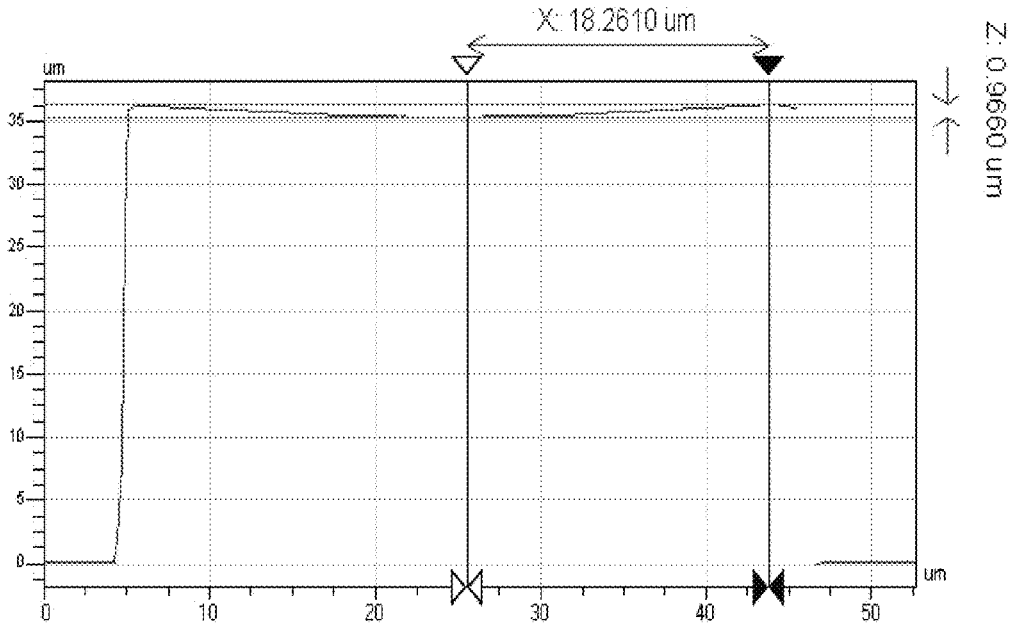
Figure 3:
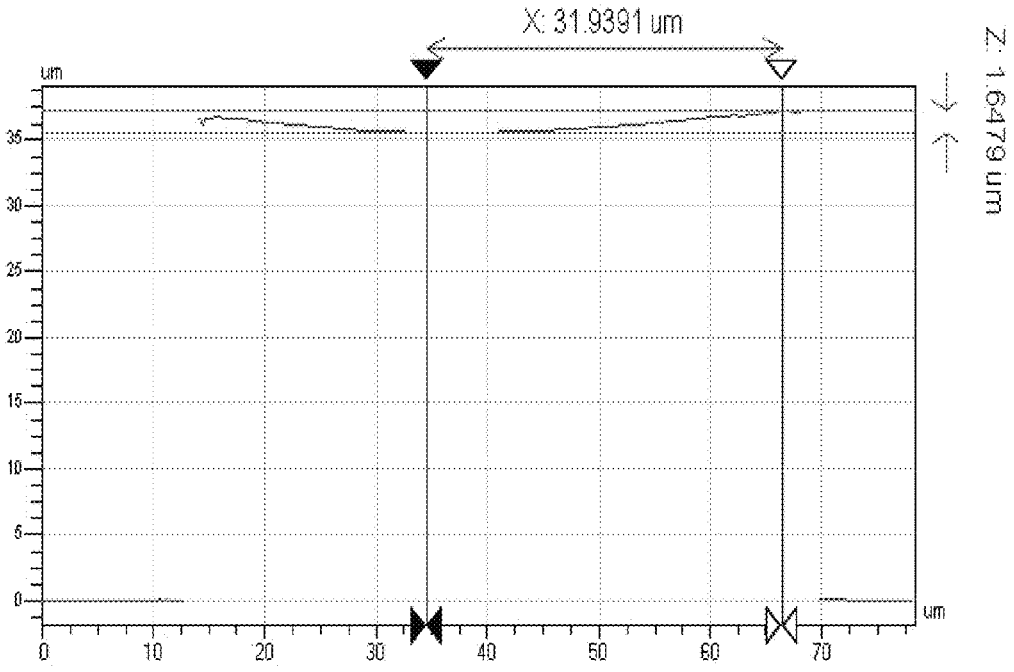
Figure 3:
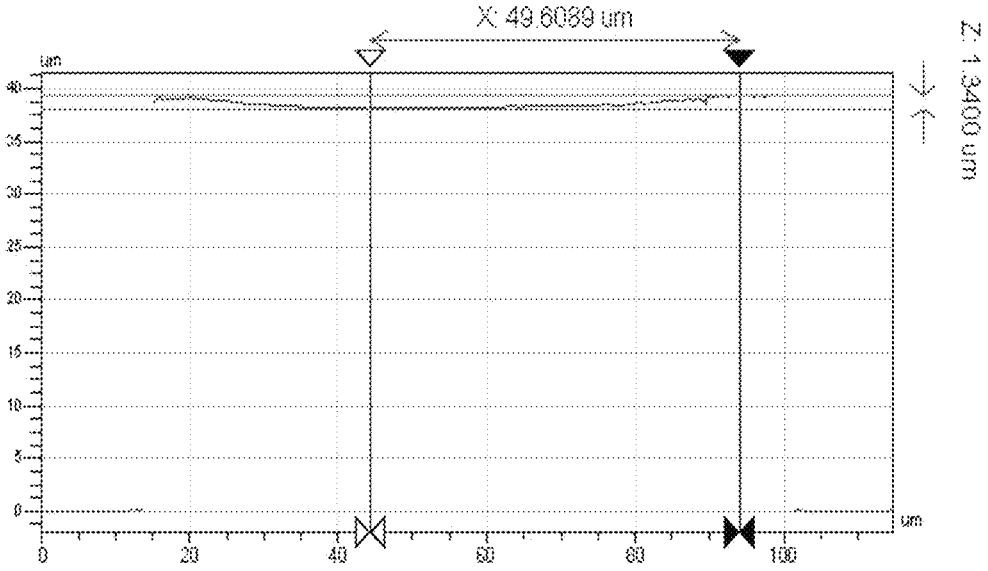
Figure 3:
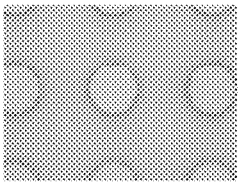
Figure 3:
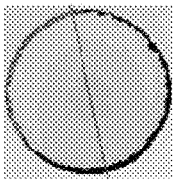
Figure 3:
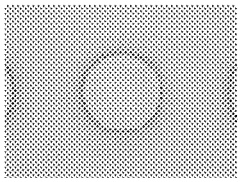
Figure 3:
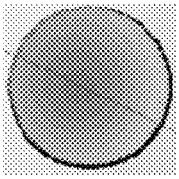
Figure 3:
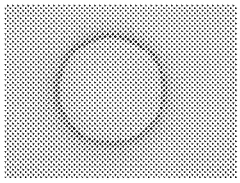
Figure 3:
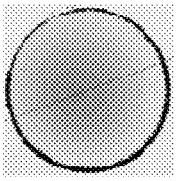
Figure 3:
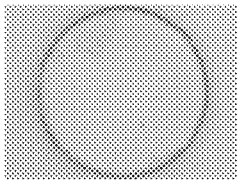
Figure 3:
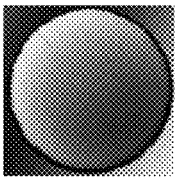

FIG. 3 shows the results of a study of the effect of levelers on electroplating multiple copper pillars according to one embodiment of the present invention. Surface profiles showing bump height difference are shown in the FIGS. 3A-D at different diameters. The within-feature uniformity for bump surface flatness is calculated by height difference within pillar/pillar height, and the among-feature uniformity is calculated by height difference among pillars at different diameters/pillar height. The calculated results are shown in the result summary table of FIG. 3E. The values of the height difference within pillar are 0.3 μm, 0.97 μm, 1.65 μm, and 1.34 μm at via diameters of 28 μm, 43 μm, 58 μm, and 88 μm respectively. The values of the within feature uniformity are 0.42%, 1.36%, 2.29%, and 1.74% at via diameters of 28 μm, 43 μm, 58 μm, and 88 μm respectively. The value of among-feature uniformity is 3.9%.

As shown form the above result, the height difference within one copper pillar and height difference among different copper pillars of different diameters are all significantly reduced to preferable levels by utilizing the electroplating leveler of the present invention.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A copper electroplating bath comprising a plating additive having a general chemical formula:

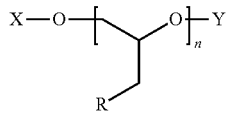

wherein X is a hydrogen, an alkyl group, a mono-alcohol, a di-alcohol, a tri-alcohol, or a poly-alcohol;

wherein Y is a hydrogen, a mono-alcohol, a di-alcohol, a tri-alcohol, or a poly-alcohol;

wherein R is a nitrogen atom containing group; and wherein n is a number from 2 to 250, wherein the plating additive is present at a concentration of 1 to 200 mg/L in the copper electroplating bath.

2. The copper electroplating bath of claim 1, wherein R is one of A, B, C, or D functional group:

A

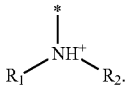

B

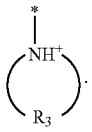

C

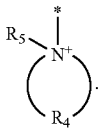

D

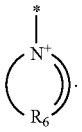

where $R_1$-$R_5$ represent methyl, ethyl or other linear or branched aliphatic chain, and $R_6$ represents aliphatic chain with conjugated double bonds.

3. The copper electroplating bath of claim 1, wherein the nitrogen atom containing group is a secondary ammonium group comprising a branched or unbranched, saturated or unsaturated linear secondary ammonium.

4. The copper electroplating bath of claim 1, wherein the nitrogen atom containing group is a cyclic ammonium group comprising a substituted or unsubstituted, saturated or unsaturated cyclic secondary ammonium.

5. The copper electroplating bath of claim 1, wherein the nitrogen atom containing group is a cyclic ammonium group comprising a saturated or unsaturated, N-substituted cyclic tertiary ammonium.

6. The copper electroplating bath of claim 1, wherein the nitrogen atom containing group is a cyclic ammonium group comprising a substituted or unsubstituted aromatic ammonium.

7. The copper electroplating bath of claim 1, wherein the general chemical formula comprises one or more derivatives represented by:

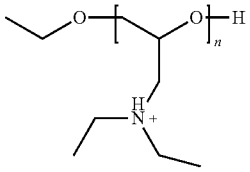

wherein n is a number from 2 to 250.

8. The copper electroplating bath of claim 1, wherein the general chemical formula comprises one or more derivatives represented by:

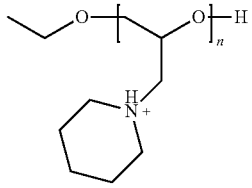

wherein n is a number from 2 to 250.

9. The copper electroplating bath of claim 1, wherein the general chemical formula comprises one or more derivatives represented by:

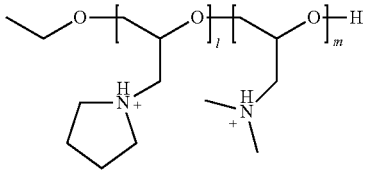

wherein l is a number from 1 to 249; and wherein m is a number from 1 to 249.

10. The copper electroplating bath of claim 1, wherein the general chemical formula comprises one or more derivatives represented by:

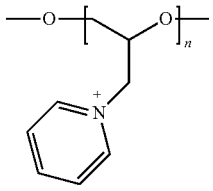

wherein n is a number from 2 to 250.

11. The copper electroplating bath of claim 1, further comprising copper ions at a concentration of 10 to 80 g/L.

12. The copper electroplating bath of claim 1, further comprising an organic acid or an inorganic acid at a concentration of 5 to 200 g/L and halogen ions at a concentration of 10 to 100 mg/L.

13. The copper electroplating bath of claim 1, further comprising one or more components selected from the group consisting of sulfoalkyl sulfonic acids, salts thereof, bis-sulfo-organic compounds and dithiocarbamic acid derivatives, wherein a concentration of said components is between 0.1 and 200 mg/L.

14. The copper electroplating bath of claim 1, further comprising a suppressor selected from the group consisting of polyethylene glycol PEG, polypropylene glycol PPG and their copolymers, wherein the concentration of said suppressor is between 10 and 2000 mg/L.

* * * * *